United States Patent [19]

Winiasz

[11] 4,281,748

[45] Aug. 4, 1981

[54] INDEXING AND SYNCHRONIZING CLUTCH MECHANISM

[76] Inventor: Michael E. Winiasz, 4009 Washington Ave., Lorain, Ohio 44052

[21] Appl. No.: 59,489

[22] Filed: Jul. 20, 1979

[51] Int. Cl.[3] ..... F16D 11/00

[52] U.S. Cl. ..... 192/28; 192/148; 74/125.5

[58] Field of Search ..... 192/28, 33 R, 148, 99 R; 74/125.5

[56] References Cited

U.S. PATENT DOCUMENTS

| | | | |
|---|---|---|---|
| 1,822,955 | 9/1931 | Card | 192/28 |
| 2,813,608 | 11/1957 | Caburet | 192/28 X |
| 3,117,681 | 1/1964 | Seymour | 192/28 X |
| 3,237,465 | 3/1966 | Aiken et al. | 192/28 X |
| 3,333,665 | 8/1967 | Einchlomb et al. | 192/99 R |
| 3,612,234 | 10/1971 | Albrecht | 192/148 X |

*Primary Examiner*—George H. Krizmanich

*Attorney, Agent, or Firm*—Pearne, Gordon, Sessions, McCoy & Granger

[57] ABSTRACT

An indexing and synchronizing clutch mechanism is disclosed which allows a driven shaft to be stopped in a precise indexing position and to be restarted from the indexing position in exact synchronization with a drive shaft. The mechanism comprises a rotatable drive wheel having an engagement means and a rotatable driven shaft. A pawl means is mounted on the driven shaft for rotation with the shaft. The pawl means is also movable into and out of engagement with the engagement means on the drive wheel whereby the driven shaft is rotated in synchronization with the drive wheel. Actuatable means are provided for moving the pawl means into and out of engagement with the drive wheel. A fixed stop is mounted adjacent to the drive wheel and is adapted to prevent rotation of the pawl means and to hold the position of the pawl means when it is moved out of engagement with the drive wheel by the actuatable means whereby the drive shaft is held in an indexing position.

15 Claims, 8 Drawing Figures

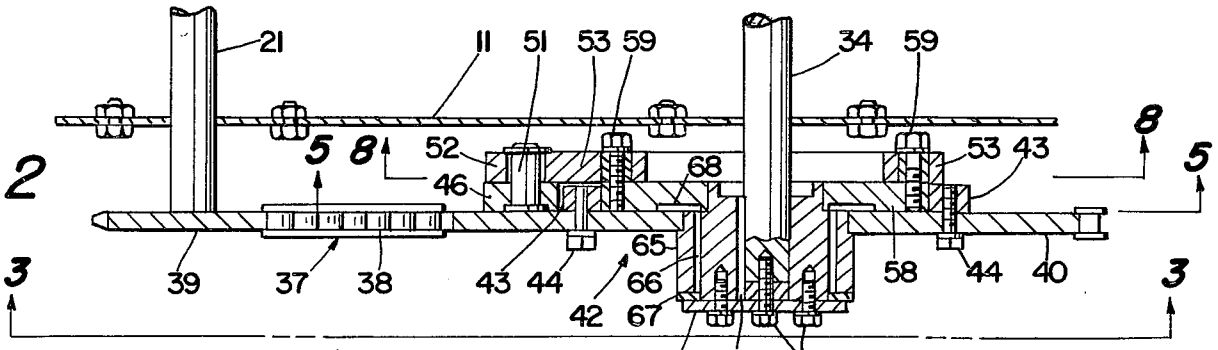
Fig. 2
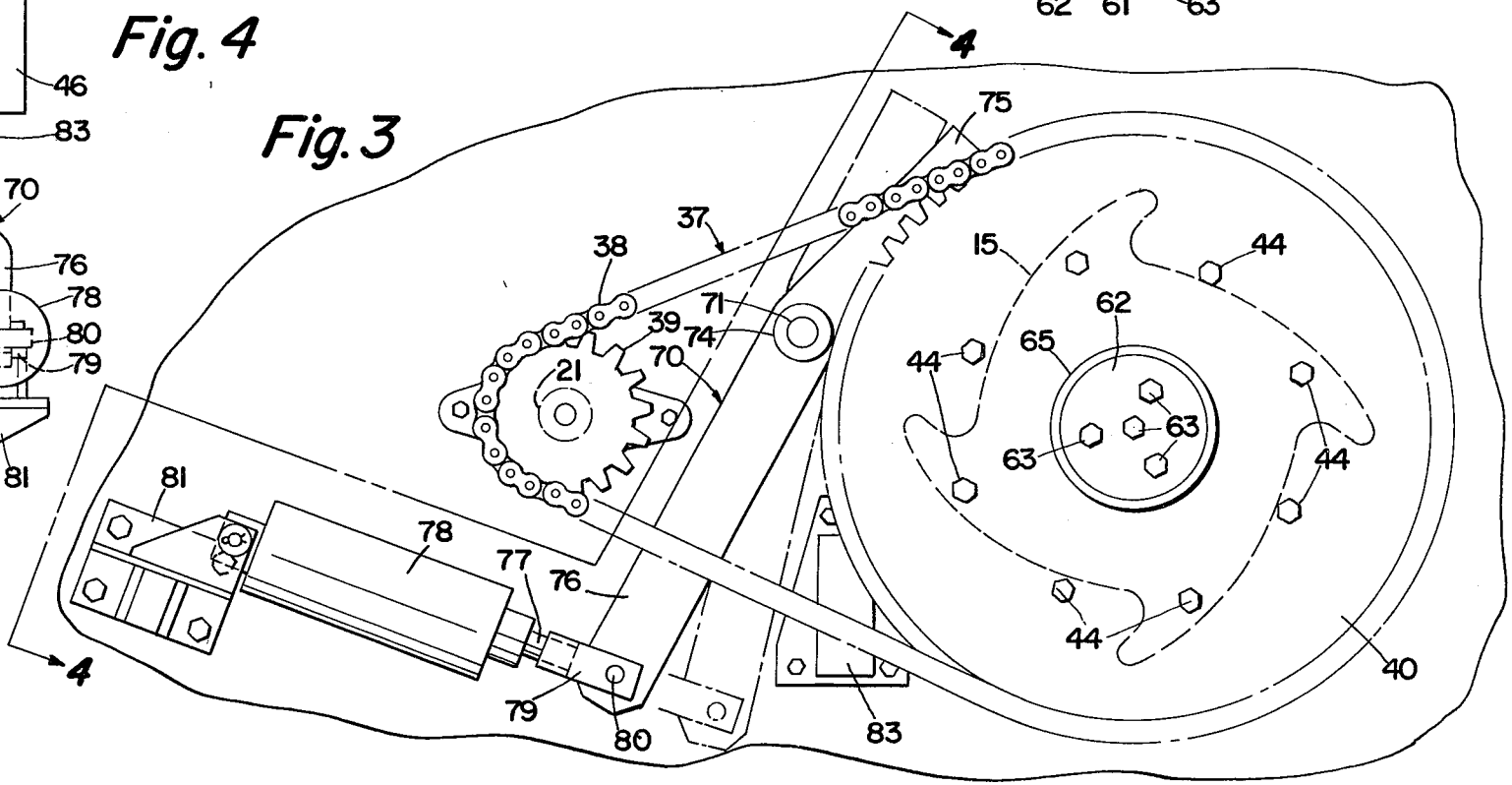
Fig. 3
Fig. 4
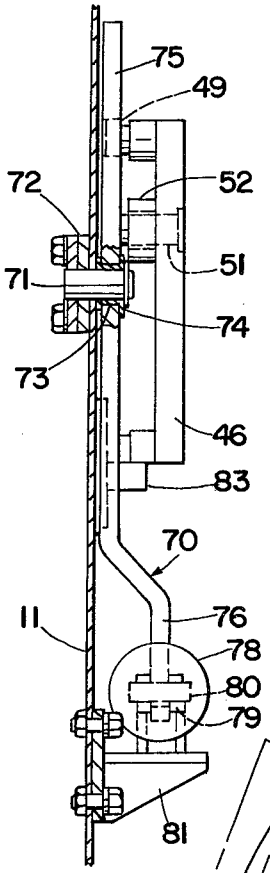

INDEXING AND SYNCHRONIZING CLUTCH MECHANISM

BACKGROUND OF THE INVENTION

1. Field of the Invention

This invention relates to positive clutch mechanisms, and particularly a clutch mechanism in which the driven shaft is maintained in an indexed position when the mechanism is disengaged, and in which the driven shaft is re-engaged from the indexing position in synchronization with the drive shaft.

2. Description of the Prior Art

Various drive mechanisms are known which include positive clutches which permit the operation of the mechanism to be disengaged when necessary. These clutches may include, for example, various types of engaging means whereby the clutch is engaged to rotate a driven shaft from a drive shaft upon the actuation of a lever, a pneumatic cylinder, or an electronic switch.

Among the features of the known clutch mechanisms may be the positioning of the driven shaft in a predetermined indexing position upon disengagement of the clutch. When the clutch is re-engaged, the driven shaft begins rotating again from the indexing position immediately upon actuation of the mechanism. Another feature of existing clutch mechanisms is the ability to begin actuation of the mechanism at a predetermined point in the rotation of the drive shaft or in the sequencing of other apparatus so that the driven shaft will rotate in synchronization with drive shaft or sequencing apparatus.

Heretofore, prior art clutch mechanisms have not included both of these capabilities. Clutch mechanisms known to the present inventor have not been capable of mechanically holding the driven shaft in a predetermined indexing position upon disengagement of the clutch mechanism, and upon re-engagement of the clutch mechanism beginning the rotation of the driven shaft from this indexing position at a point of time after re-engagement of the clutch mechanism so that the driven shaft will rotate in the same synchronization with drive shaft or sequential apparatus, as before disengagement.

The need for such an indexing clutch mechanism which incorporates both capabilities has been found in apparatus which changes the incremental length between articles moving in an automatic assembly. In such an apparatus, the articles enter a feed control means in close proximity to each other and are separated and driven at a greater speed so that the articles are thereafter moving at a greater speed and separated by a greater distance. A rotating stopping device, such as a star wheel, is used to control the feed of the articles, and this device must be rotating in synchronization with the indexing mechanisms downstream, so that each article is placed in the proper position and separated by the proper distance. If it is necessary to halt the feed of articles to the apparatus, the rotating stopping device must be halted in a predetermined indexing position so that the articles entering the apparatus will be maintained in a position in which the assembly can be restarted. When the feed of articles to the apparatus is restarted, the rotating device must begin rotation from its indexing position exactly in synchronization with the downstream mechanisms.

Clutch mechanisms known heretofore have not been found suitable for the purposes of maintaining synchronization between a driven shaft on which a rotating stopping device may be mounted and a drive shaft which may be connected to the downstream mechanisms, assuring placement of the drive shaft in a preset indexing position upon disengagement of the clutch mechanism, and maintaining synchronization after re-engagement of the mechanism.

SUMMARY OF THE INVENTION

The limitations of the prior art mechanisms have been overcome by the present invention, which provides the capabilities of rotating a driven shaft in synchronization with a drive shaft, of mechanically stopping the driven shaft at a precise indexing location upon disengagement, and of restarting the driven shaft from the indexing position in the same synchronization with the drive shaft upon re-engagement regardless of the time at which the clutch mechanism is re-engaged. In addition, the mechanism of the present invention provides an effectively instantaneous acceleration of the driven shaft upon engagement of the mechanism, thereby eliminating transient problems of synchronization between the drive shaft and the driven shaft upon engagement of the mechanism. The mechanism also provides means for stopping the driven shaft at any time by deactuation of the mechanism whereby the driven shaft will be stopped at a predetermined orientation so that precision positioning of the driven shaft is provided.

These and other advantages are provided by the indexing and synchronizing clutch mechanism of the present invention. The mechanism comprises a rotatable drive wheel having engagement means and a rotatable driven shaft. A pawl means is mounted on the driven shaft for rotation therewith. The pawl means is also movable into and out of engagement with the drive wheel whereby the driven shaft is rotated in synchronization with the drive wheel. Actuatable means are provided for moving the pawl means into and out of engagement with the drive wheel. A fixed stop is mounted adjacent to the drive wheel and is adapted to prevent rotation of the pawl means and to hold the position of the pawl means when it is moved out of engagement with the drive wheel by the actuatable means whereby the driven shaft is held in an indexing position.

BRIEF DESCRIPTION OF THE DRAWINGS

FIG. 2 is a top plan sectional view of the indexing clutch mechanism of the present invention.

FIG. 3 is a side elevational view of the indexing clutch mechanism, taken along line 3—3 of FIG. 2, and showing the chain drive wheels shown in FIG. 1 to a larger scale.

FIG. 4 is a side elevational view taken along line 4—4 of FIG. 3.

DETAILED DESCRIPTION OF THE PREFERRED EMBODIMENT

Figure 1:
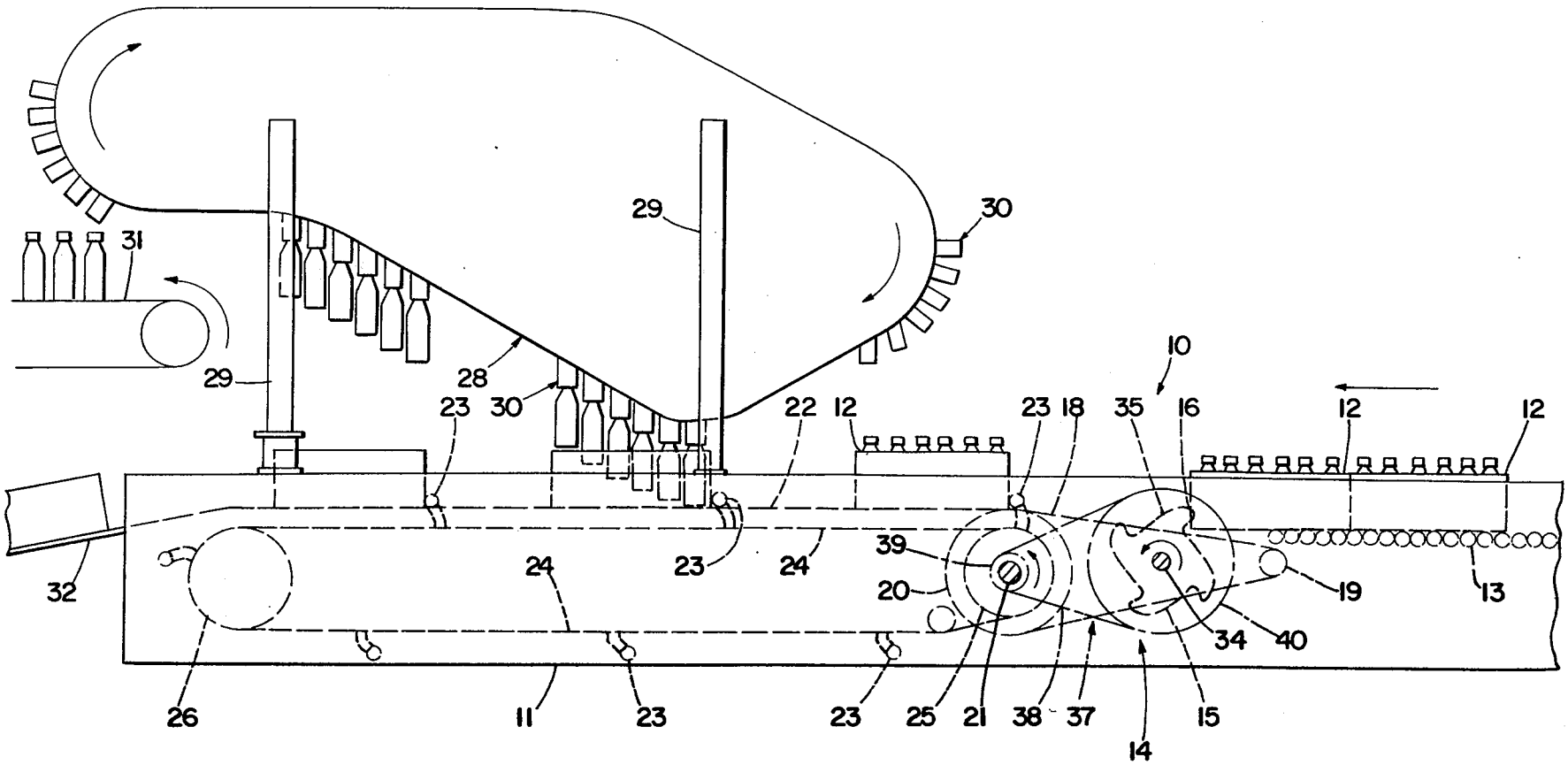
FIG. 1 is a side elevational view of an article feed control apparatus which utilizes the indexing clutch mechanism of the present invention.

Referring initially to FIG. 1, the indexing clutch mechanism of the present invention has particular application in an article feed control apparatus such as an apparatus 10 for feeding cases containing bottles or similar items to an unloading machine. The apparatus 10 includes a pair of vertically extending sidewalls 11 which form a channel therebetween. Articles, such as cases 12, are fed through this channel between the two side walls 11. The cases 12 are supplied on a roller feed conveyor 13 to an article feed control means 14. The feed conveyor 13 is inclined slightly so that the cases 12 are urged by gravity down the rollers of the conveyor 13 and toward the feed control means 14. The feed control means 14 includes a rotatable star wheel 15 which has a plurality of teeth 16, one of which may project radially outwardly and extend above the level of the feed conveyor 13 to hold a case 12 in position at the end of the conveyor 13. In the preferred form, the star wheel 15 has four such teeth 16.

At the end of the feed conveyor 13, the cases 12 are taken on a transfer conveyor 18 between a shaft 19 at the end of the feed conveyor 13 and a wheel 20. The wheel 20 is mounted on and driven by a drive shaft 21, which, in turn, drives the transfer conveyor 18. The cases 12 are fed from the transfer conveyor 18 to a platform 22 where the cases are moved by pushing member 23. The pushing members are mounted on an endless chain 24 which is located beneath the platform 22 and extends between sprocket wheels 25 and 26. The sprocket wheel 25 is mounted on the drive shaft 21 for rotation therewith, so that the speed of the pushing members 23 moving along the platform 22 is controlled by and synchronized with the speed of the drive shaft 21.

Another conveyor 28 is supported above the platform 22 by support members 29 which are mounted on top of the sidewalls 11. The conveyor 28 contains a plurality of groups of article handling members 30. The conveyor 28 moves in synchronization with the chain 24 and the members 30 are in synchronous position with the pushing members 23 so that a case full of bottles is presented directly beneath the article handling members 30 at a point approximately in the middle of the platform 22. The members 30 include means for gripping the articles in each case so that the articles may be removed from the case and placed on a separate conveyor 31 for subsequent operations, such as cleaning and filling. The empty cases are moved along the platform 22 by the members 23 until they come to the end of the platform, at which point the cases roll down a roller conveyor 32 to a collection point.

The control of the position of the cases 12 on the platform 22 between the members 23 is accomplished by the star wheel 15 which is mounted for rotation on a shaft 34. As shown in FIG. 1, the star wheel 15 contains a number of teeth 16, preferably four teeth, each of which may engage the end of a case 12 at the end of the feed conveyor 13. As the star wheel 15 rotates, the tooth 16 holding the case 12 moves in a counterclockwise direction (as shown in FIG. 1) away from the feed conveyor 13, which allows the case 12 to be pushed onto the transfer conveyor 18 and moved up onto the platform 22. Since the level of the platform 22 is above that of the feed conveyor 13, the forward end of the case is pulled upwardly by the conveyor 18, while the trailing end of the case is lifted upwardly by the camming surface 35 on the star wheel 15 located between the teeth 16. As the rear end of the case is lifted upwardly by the star wheel, the next tooth 16 engages the front end of the next case 12 on the feed conveyor 13. In this manner, the cases are fed individually from the feed conveyor 13 onto the platform 22.

The rotation of the star wheel 15 must be synchronized with the position of the pushing members 23 on the moving chain 24 so that a case is fed onto the platform 22 between each adjacent pair of the pushing members 23. If the star wheel 15 were to become unsynchronized with the movement of the chain 24, a case might be fed directly on top of a pushing member 23, jamming the apparatus.

To synchronize the rotation of the star wheel 15 with the movement of the chain 24 containing the pushing members 23, the star wheel 15 is connected to the drive shaft 21 by a chain drive 37. The chain drive 37 comprises a chain 38 connecting a wheel 39 mounted on the drive shaft 21 and a wheel 40 on the shaft 34 upon which the star wheel 15 is mounted. The drive shaft 21 thus controls and is synchronized with the movement of the chain 24 carrying the pushing members 24 through the wheel 25, and the rotation of the star wheel 15 through the chain drive 37.

The chain drive 37 is seen in more detail in FIGS. 2 and 3. The drive shaft 21 and the driven shaft 34 extend through the sidewall 11 of the apparatus and the sprocket wheels 40 and 39 are mounted on the outside of the sidewall. The chain 38 connects the sprocket wheels 39 and 40 so that the shaft 34 upon which the star wheel 15 is mounted is driven in synchronization with the drive shaft 21.

Occasionally, it will be necessary to halt the feed of articles into the apparatus. Such an occasion will arise when the apparatus is to be shut down or when a misfeed or jam in the apparatus requires that the feed of articles to the apparatus be stopped immediately. In such situations, it is common to continue moving articles through the apparatus but to halt the flow of new articles into the apparatus. The apparatus continues to operate until it has cleared all existing articles therefrom. It is thus necessary that the star wheel 15 be stopped in the proper position, with one of the teeth 16 extending upwardly and engaging the end of a case 12, so that the cases 12 on the feed conveyor 13 can be held while the chain 24 continues to move and the pushing members 23 continue to push the remaining cases on the transport conveyor 22 through the apparatus. This stopping position of the star wheel 15 with one of the teeth 16 extending upwardly, which is shown in FIG. 1, is referred to hereinafter as the "indexing position." When it is desired to re-introduce cases into the apparatus, the rotation of the star wheel 15 must be initiated exactly in synchronization with the movement of the pushing members 23 so that the first case is fed directly onto the platform 22 between the pushing members 23. Thus, when the apparatus is re-started, it is necessary that the star wheel 15 begin rotation from its indexing position at which it was stopped, and that it begin rotation exactly in synchronization with the drive shaft 21 so that it is in synchronization with the pushing members 23.

Figure 5:
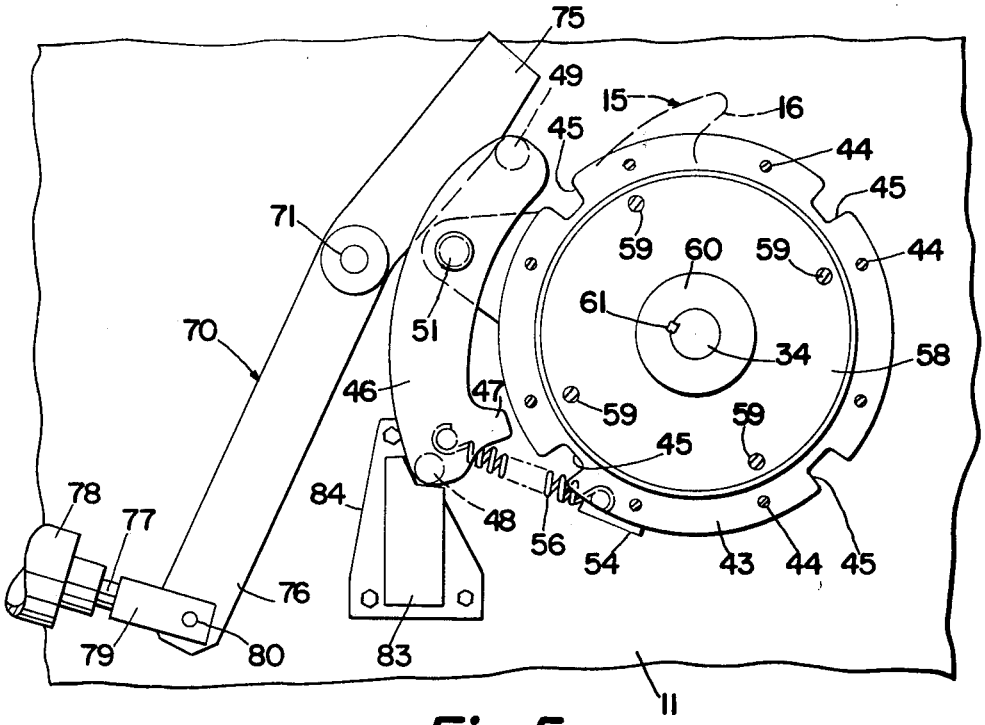
FIG. 5 is a front elevational view in section, taken along line 5—5 of FIG. 2 and showing the mechanism when it is disengaged.
Figure 8:
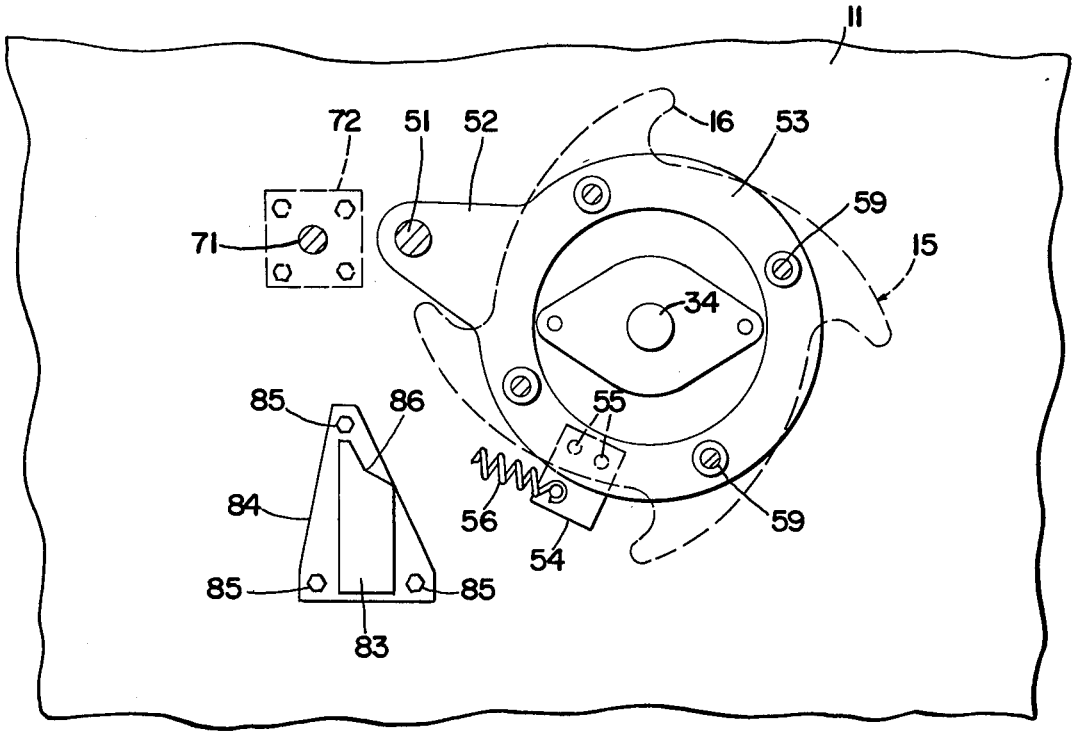
FIG. 8 is a front elevational view in section, taken along line 8—8 of FIG. 2.

To accomplish these operations, the drive mechanism is provided with an indexing actuation and deactuation clutch means 42, which is shown in FIGS. 2, 4, and 5. The clutch means 42 includes a ring 43 concentrically mounted on the sprocket wheel 40 (FIG. 2) on the side of the wheel 40 adjacent to the sidewall 11. The ring 43 is attached to the sprocket wheel 40 by a plurality of bolts 44 or other fastening means. As shown in FIG. 5, the ring 43 includes a plurality of notches 45 which extend radially inwardly from the outer periphery of the ring. The number of notches 45 is preferably identical to the number of teeth 16 on the star wheel 15, and the notches are circumferentially spaced equally around the ring 43. The ring 43 is engaged by a pawl 46 having at one end a tooth 47 extending from its side which may engage any of the notches 45. The pawl 46 also has a pair of stop engaging knobs 48 and 49 (FIGS. 4 and 5) which extend from the pawl inwardly toward the sidewall 11 and which are mounted at each end of the pawl. The central portion of the pawl 46 is pivotally mounted by means of a pin 51 on a portion 52 which projects radially outwardly from a second ring 53 (FIG. 8). The ring 53 is concentric with the wheel 40 and the ring 43 and coaxial with the shaft 34 and is located between the ring 43 and the sidewall 11 directly adjacent to the ring 43 (FIG. 2). The ring 53 also has a projection 54 (FIG. 8) attached to the ring by bolts 55 or other means and extending radially outwardly approximately 90 degrees from the radially extending portion 52. Opposite ends of an extension spring 56 (FIG. 5) are connected to the pawl 46 and the projection 54, so that as the pawl moves pivotally on the pin 51, it is pulled into engagement with one of the notches 45 on the ring 43 (FIG. 6).

The ring 53 is attached to a concentric inner hub wheel 58 which is located on one side of the ring 53 away from the sidewall 11 (FIG. 2). The ring 53 is attached to the hub wheel 58 by a plurality of bolts 59. The wheel 58 is mounted on the shaft 34 by means of a cylindrical central hub portion 60 which extends from the side of the wheel 58 away from the sidewall 11. The hub portion 60 contains an inner key 61 which engages a corresponding groove on the shaft 34 so that the hub wheel 58 rotates with the shaft 34. The end of the shaft is covered by a plate 62 which is attached to the shaft and to the hub portion 60 by bolts 63 (FIGS. 2 and 3).

The sprocket wheel 40 also has a central cylindrical sleeve 65 (FIG. 2) which extends from the side of the wheel 40 away from the sidewall 11 and which fits around the hub portion 60 of the wheel 58. A suitable bearing 66 is interposed between the sleeve 65 and the inner hub portion 60, so that the sprocket wheel is free to rotate about the axis of the shaft 34. Bearings 67 and 68 are also provided between the end of the sleeve 65 and the plate 62 and between the sprocket wheel 40 and the hub wheel 58, so that the sprocket wheel is maintained in position and prevented from moving axially with respect to the shaft 34.

Figure 6:
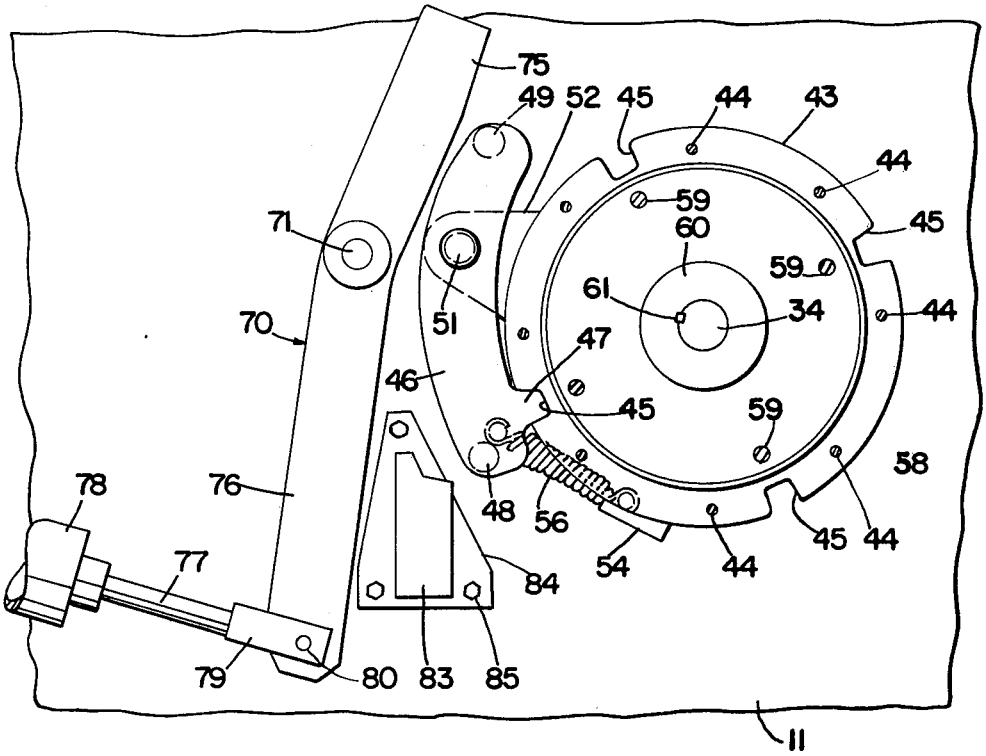
FIG. 6 is a side elevational view in section similar to FIG. 5, showing the mechanism upon engagement.
Figure 7:
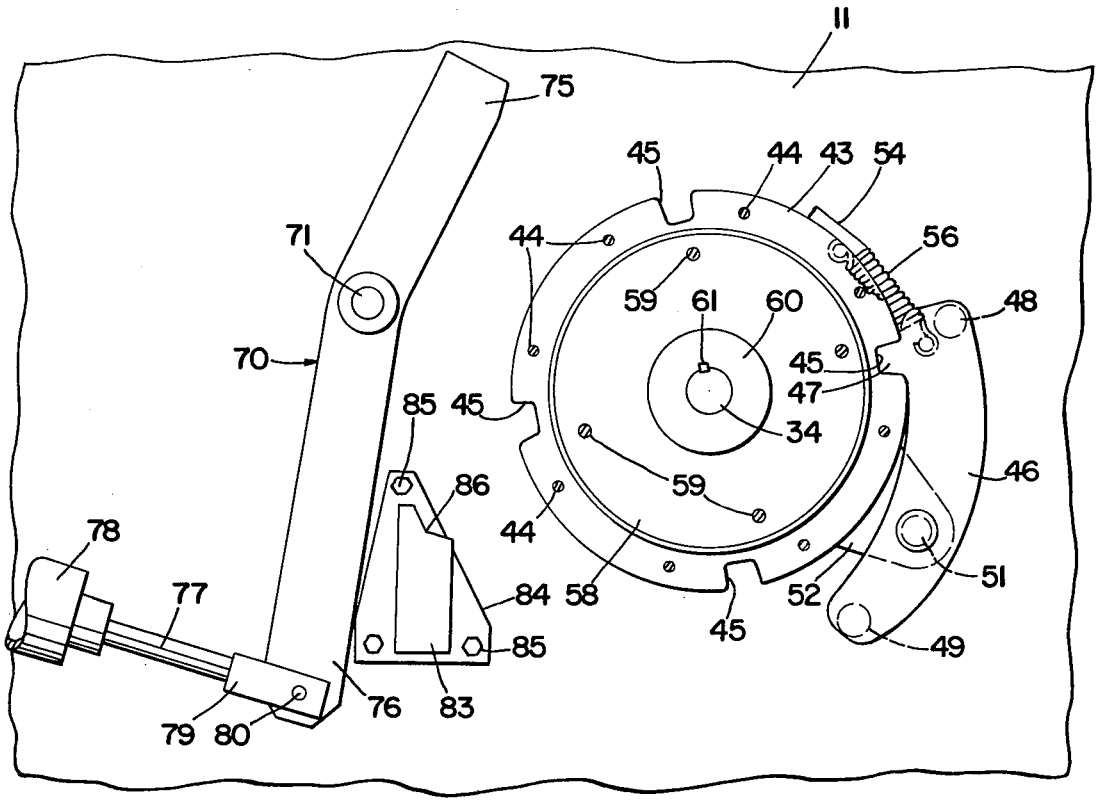
FIG. 7 is a side elevational view similar to FIG. 6, showing the mechanism in its engaged position.

With the mechanism in its engaging position as shown in FIG. 6, the spring 56 pivots the pawl 46 on the pin 51 so that the tooth 47 engages one of the notches 45 on the ring 43. As the sprocket wheel 40 is driven by the chain drive 37 from the drive shaft 21, the ring 43, which is attached to the sprocket wheel by the bolts 44, also rotates. Since the pawl 46 engaged with the rotating ring 43, the second ring 53, upon which the pawl 46 is mounted, rotates with the ring 43 (FIG. 7). The rotation of the second ring 53 causes rotation of the hub wheel 58 which is attached to the ring 53 by the bolts 59. The rotating hub wheel 58 drives the rotation of the driven shaft 34 through the hub portion 60.

In order to disengage the mechanism, it is necessary for the pawl 46 to disengage the ring 43. The disengagement is actuated by engagement of an extending lever arm 70 (FIG. 5) with the pin 49 which extends from the pawl 46. The lever arm 70 is pivotally mounted to the sidewall 11 by means of a journal pin 71. The pin 71 is welded to a mounting plate 72 which is bolted to the sidewall 11 (FIGS. 4 and 8) and extends through the sidewall and through a central opening in the lever arm 70. A suitable bushing or flange bearing 73 (FIG. 4) is provided in the opening around the pin 71, and the lever arm 70 is held in place on the pin by a snap ring 74 (FIGS. 3 and 4) or other suitable means. The arm 70 comprises an upoer extending portion 75 and a lower portion 76. The pivotal movement of the lever arm 70 about the pin 71 is accomplished by attachment of the end of the lower portion 76 to a rod 77 extending from a pneumatic cylinder 78 (FIG. 3) or other actuating means. The rod 77 is attached to the arm 70 by a U-shaped mounting bracket 79 on the end of the rod which extends around the lower arm portion 76, and a pin 80 which extends through the bracket 79 and the lower arm portion. The cylinder 78 may be mounted on the sidewall 11 by a bracket 81.

When the mechanism is in its engaged position, as shown in FIGS. 6 and 7, the rod 77 is fully extended from the cylinder 78 so that the lower portion 76 of the arm 70 is in its rightmost position as shown in the drawings, and the upper arm portion 75 of the arm is in its leftmost, or retracted, position. In this position, the lever arm 70 does not contact the pawl 46, and the pawl remains in engagement with the ring 43 as the ring and the pawl both rotate. To disengage the mechanism, the rod 77 is retracted into the cylinder 78, moving the lower portion 76 of the arm 70 to the left as shown in the drawings, and moving the upper arm portion 75 to the right, as shown in FIG. 5. In this position, the forward portion 75 of the lever arm 70 contacts the knob 49 extending from the pawl 46 as the pawl rotates. This engagement causes the knob 49 to be forced radially inwardly toward the shaft 34 so that the pawl 46 pivots about the pin 51 and the end of the pawl containing the tooth 47 is forced radially outwardly from the shaft 34, disengaging the tooth 47 from the ring 43 and extending the spring 56.

A fixed stop 83 is also mounted on the sidewall 11 by means of a plate 84 which is attached to the sidewall by bolts 85 or other means. The stop 83 includes an indented portion 86 (FIG. 8) which is adapted to contact and receive the knob 48 which extends from the pawl 46. The fixed stop 83 is located such that it engages and holds the knob 48 when the pawl is in its disengaged position as shown in FIG. 5.

Thus, upon actuation of the cylinder 78, the lever arm 70 moves into position to engage the knob 49 on the rotating pawl 46 to disengage the tooth 47 on the pawl from the corresponding notch 45 in the ring 43 and to force the pin 48 into engagement with the indented portion 86 of the fixed stop 83 so that the pawl is firmly secured in a fixed disengaged position. The ring 43 continues to rotate, since it is connected to the sprocket wheel 40 which is driven by the drive shaft 21. However, the driven shaft 34 is fixed in a predetermined location by reason of its attachment through the hub wheel 58 and the second ring 53 to the pawl 46 which is locked in position between the fixed stop 83 and the lever arm 70. In this manner, the driven shaft 34 is locked in a predetermined indexing position immediately upon engagement of the mechanism by operation of the cylinder 78. This locked position of the driven shaft 34 corresponds to the indexing position previously discussed in which one of the teeth 16 on the star wheel 15 extends upwardly (FIG. 5) to engage the end of a case 12 on the end of the feed conveyor 13 (FIG. 1).

When it is desired to re-engage the mechanism, the driven shaft 34 must rotate precisely in synchronization with the drive shaft 21. Upon actuation of the cylinder 78 extending the rod 77, the lever arm 70 moves to its retracted position with the upper portion 75 clear of the pawl 46. The spring 56 pulls the adjacent end of the pawl 46 containing the tooth 47 into engagement with one of the notches 45 on the rotating ring 43. The number and position of the notches 45 on the ring 43 correspond to the number and position of the teeth 16 on the star wheel 15. Thus, the connection between the pawl 46 and the ring 43 will only occur when the pawl and the ring are in desired synchronization by means of a possible engagement between the tooth 47 and one of the notches 45, and it would not be possible for the driven shaft 34 to begin rotation at the wrong position of one of the pushing members 23 on the chain 24, so that the star wheel tooth 16 would recede and allow a case 12 to be placed on one of the pushing members. Instead, when the pushing members 23 are in the desired position so that the star wheel 15 may begin rotation, the ring 43 will be in position to permit the pawl 46 to engage one of the notches 45 in the ring, since the position of the pushing members 23 corresponds to the position of the ring 43 by reason of the interconnection through the drive shaft 21, the chain drive 37, and the sprocket wheel 40, and the position of the star wheel 15 corresponds to the position of the pawl 46 by reason of the interconnection through the driven shaft 34, the hub wheel 58, and the second ring 53. The receding movement of the tooth 16 on the rotating star wheel 15 will be exactly in synchronization with the movement of the pushing member 23 by reason of the engagement of the tooth 47 on the pawl 46 with one of the notches 45 at the precise moment necessary for synchronization.

While the invention has been shown and described with respect to a specific embodiment thereof, this is intended for the purposes of illustrations rather than limitations, and further modifications and variations will be apparent to those skilled in the art all within the intended spirit and scope of this invention.

What is claimed is:

1. An indexing and synchronizing clutch mechanism which comprises:

a rotatable drive wheel having an engagement means;

a rotatable driven shaft;

a pawl means mounted on the driven shaft for rotation therewith, the pawl means also being movable into and out of engagement with the engagement means on the drive wheel whereby the driven shaft is rotated in synchronization with the drive wheel, the pawl means having a pair of projecting portions;

actuatable means capable of engaging one of the projecting portions for moving the pawl means into and out of engagement with the drive wheel; and a fixed stop mounted adjacent to the drive wheel and adapted to engage the other of the projecting portions and to prevent rotation of the pawl means and hold the position of the pawl means when it is moved out of engagement with the drive wheel by the actuatable means whereby the driven shaft is securely held in an indexing position and is incapable of rotation.

2. An indexing and synchronizing clutch mechanism as in claim 1, wherein the engagement means comprises a notch on the periphery of the drive wheel.

3. An indexing and synchronizing clutch mechanism as in claim 1, wherein the driven shaft is coaxial with the drive wheel.

4. An indexing and synchronizing clutch mechanism as in claim 1, wherein the actuatable means comprises a lever arm adapted to engage the pawl means and move the pawl means out of engagement with the engagement means on the drive wheel.

5. An indexing and synchronizing clutch mechanism as in claim 4, wherein the lever arm is moved by a fluid cylinder.

6. An indexing and synchronizing clutch mechanism which comprises:

a rotatable drive wheel having an engagement means;

a rotatable drive shaft;

a pawl means mounted on the drive shaft for rotation therewith, the pawl means also being movable into and out of engagement with the engagement means on the drive wheel whereby the drive shaft is rotated in synchronization with the drive wheel, the pawl means having a pair of extending knobs;

actuatable means for moving the pawl means into and out of engagement with the drive wheel, one knob adapted to be engaged by the actuatable means to move the pawl means into and out of engagement with the drive wheel; and a fixed stop mounted adjacent to the drive wheel and adapted to prevent rotation of the pawl means and hold the position of the pawl means when it is moved out of engagement with the drive wheel by the actuatable means whereby the driven shaft is held in an indexing position, the other knob adapted to be engaged by the fixed stop to hold the position of the pawl means when the pawl means is out of engagement with the drive wheel.

7. An indexing and synchronizing clutch mechanism as in claim 1, comprising in addition means for urging the pawl means into engagement with the drive wheel when the actuatable means does not move the pawl means out of engagement with the drive wheel.

8. An indexing and synchronizing clutch mechanism as in claim 7, wherein the urging means comprises an extension spring attached between the pawl means and a member attached to the driven shaft.

9. An indexing and synchronizing clutch mechanism as in claim 1, comprising in addition a chain drive connecting the rotatable drive wheel with a drive shaft.

10. An indexing and synchronizing clutch mechanism as in claim 1, wherein the drive wheel includes a ring having a plurality of notches, any of which may be engaged by the pawl means.

11. An indexing and synchronizing clutch mechanism as in claim 1, wherein the pawl means is pivotally attached to a member mounted on the driven shaft, the pawl means being pivotally movable about its attachment to engage the engagement means on the drive shaft.

12. An indexing and synchronizing clutch mechanism which comprises:

a drive shaft;

a rotatable drive wheel driven by the drive shaft, the drive wheel having a plurality of engagement notches on its periphery;

a rotatable driven shaft coaxial with the drive wheel;

a wheel mounted on the driven shaft;

a pawl pivotally attached to the wheel and rotatable with the wheel, the pawl means having a pair of extending knobs, the pawl being pivotally movable about its attachment into and out of engagement with any of the notches on the drive wheel, whereby the driven shaft is rotated in synchronization with the drive wheel;

an actuatable lever arm pivotally mounted adjacent to the drive wheel and adapted to be pivotally moved to engage with one of the knobs on the pawl to pivotally move the pawl out of engagement with the notches on the drive wheel;

a fluid cylinder attached to the arm for pivotally moving the arm;

means for urging the pawl into engagement with one of the notches when the pawl is disengaged by the arm, the urging means comprising a spring connecting the pawl with the wheel; and a fixed stop mounted adjacent to the drive wheel and adapted to engage the other of the knobs and to prevent rotation of the pawl and hold the position of the pawl when the pawl is moved by the arm out of engagement with the notches in the drive wheel, whereby the pawl is secured between the arm and the fixed stop and the driven shaft is held in an indexing position.

13. An indexing and synchronizing clutch mechanism as in claim 12, wherein the drive wheel is driven by the drive shaft by means of a chain drive connecting the drive wheel with the drive shaft.

14. An indexing and synchronizing clutch mechanism as in claim 12, wherein the drive wheel includes a ring having the engagement notches.

15. An indexing and synchronizing clutch mechanism as in claim 1, wherein the projecting portions on the pawl means comprise extending knobs.

* * * * *